US006955151B2

(12) United States Patent
Naljotov et al.

(10) Patent No.: US 6,955,151 B2
(45) Date of Patent: Oct. 18, 2005

(54) INTERNAL COMBUSTION ENGINE

(76) Inventors: Oleg Naljotov, 1975 84 St., Apt. B2, Brooklyn, NY (US) 11214; Valentin Potienko, 1975 84 St., Apt. B2, Brooklyn, NY (US) 11214

( * ) Notice: Subject to any disclaimer, the term of this patent is extended or adjusted under 35 U.S.C. 154(b) by 0 days.

(21) Appl. No.: 10/155,278

(22) Filed: Jul. 2, 2002

(65) Prior Publication Data

US 2004/0003783 A1 Jan. 8, 2004

(51) Int. Cl.[7] ..... F02B 75/32
(52) U.S. Cl. ..... 123/197.1; 123/61 R; 123/55.2
(58) Field of Search ..... 123/61 R, 61 V, 123/62, 63, 55.2, 55.3, 55.4, 55.5, 55.6, 55.7, 197.1, 197.2, 197.3, 197.4; 74/50

(56) References Cited

U.S. PATENT DOCUMENTS 3,710,767 A * 1/1973 Smith ..... 123/63
5,673,665 A * 10/1997 Kim ..... 123/197.1
6,539,835 B1 * 4/2003 Rasmussen ..... 74/50

* cited by examiner

*Primary Examiner*—Noah P. Kamen
(74) *Attorney, Agent, or Firm*—I. Zborovsky

(57) ABSTRACT

An internal combustion engine has two cylinders located opposite to one another, two pistons each movable in a respective one of the cylinders and connected with one another so as to move jointly in said cylinders in two opposite directions, and means for converting the joint movement of the pistons into a rotary movement, valve means provided in the cylinders, so that when the cylinders jointly move in one direction one of the cylinders perform a working stroke in one of the cylinders, while when the pistons jointly move in an opposite direction the other of the pistons perform a working stroke in the other of the cylinders.

2 Claims, 3 Drawing Sheets

INTERNAL COMBUSTION ENGINE

BACKGROUND OF THE INVENTION

The present invention relates to internal combustion engines.

More specifically it relates to two stroke internal combustion engines.

SUMMARY OF THE INVENTION

It is an object of the present invention to provide a new internal combustion engine which has a 100 percent compression and a high power source, and which is environmentally clean, has high efficiency, and has a small size and weight.

In keeping with these objects, one feature of the present invention resides, briefly stated in an internal combustion engine which has two cylinders located opposite to one another, two pistons each movable in a respective one of said cylinders and connected with one another so as to move jointly in said cylinders in two opposite directions; and means for converting the joint movement of said pistons into a rotary movement; valve means provided in said cylinders, so that when said cylinders jointly move in one direction one of said cylinders performs a working stroke in one of said cylinders, while when said pistons jointly move in an opposite direction the other of said pistons perform a working stroke in the other of said cylinders.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
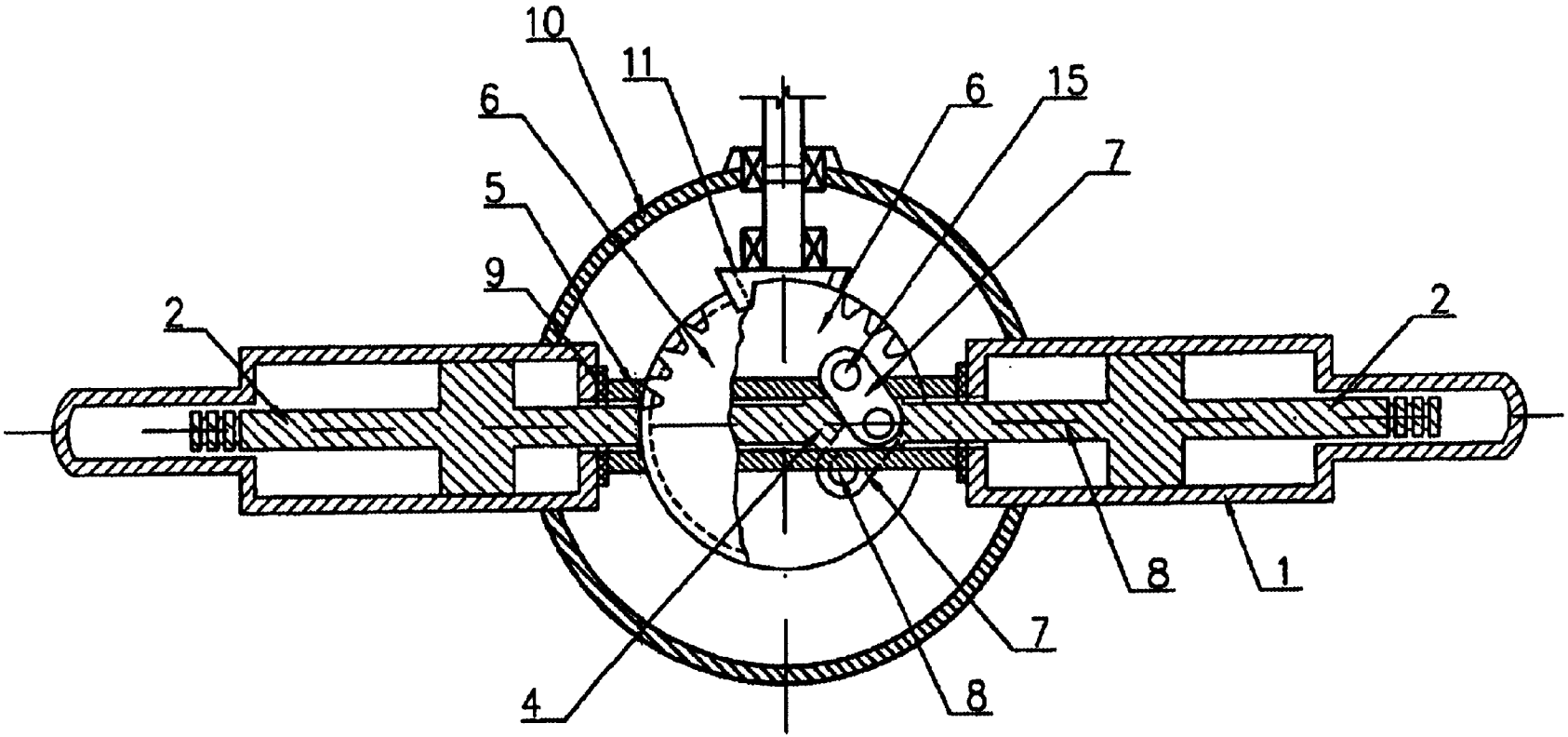
FIG. 1 is a view showing a cross-section of an internal combustion engine in accordance with the present invention.

An internal combustion engine in accordance with the present invention has a body which is identified with reference numeral 10 and two cylinders 1 located opposite to one another.

Figure 2:
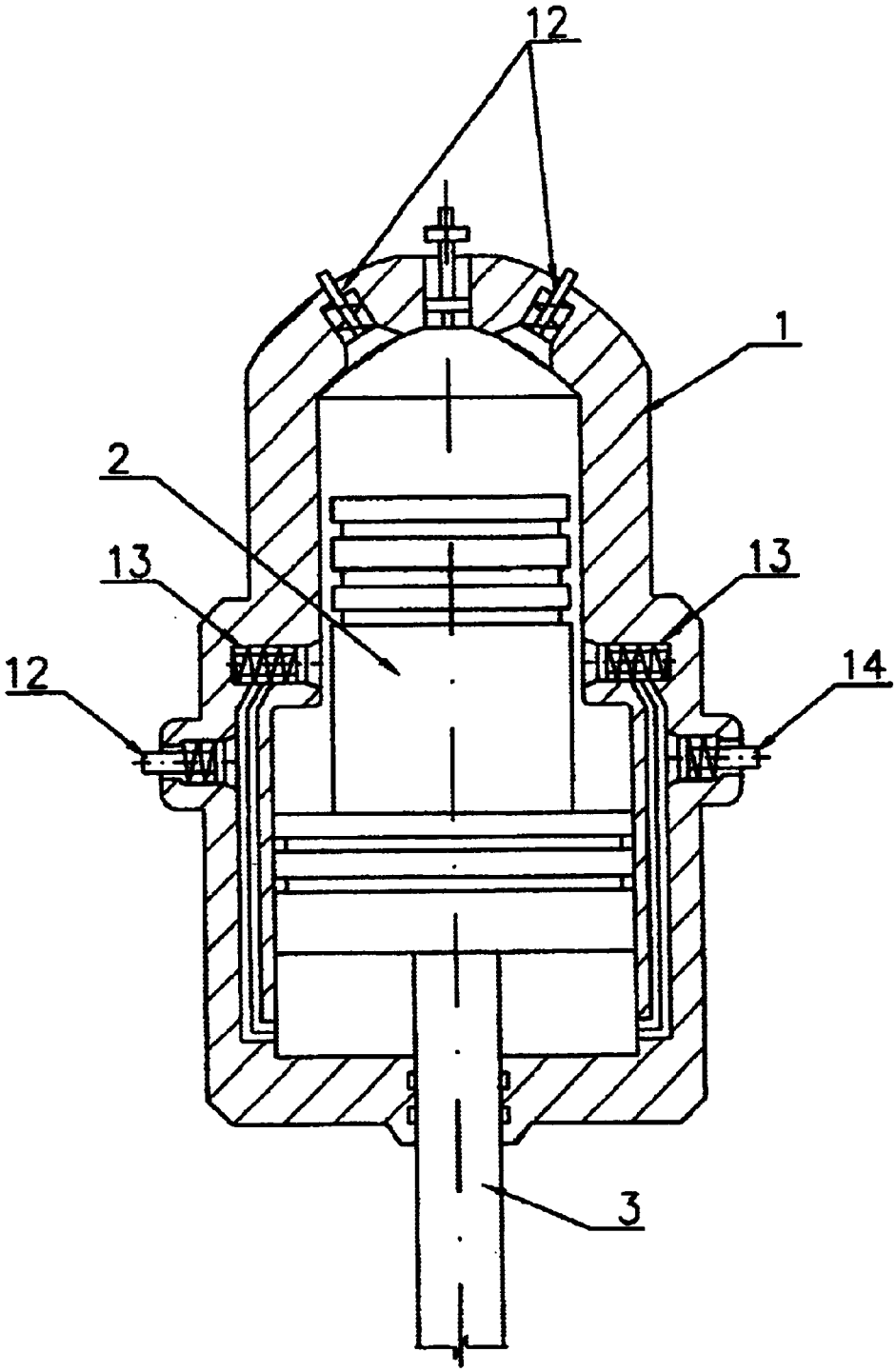
FIG. 2 is a view showing a cross-section of one of the cylinders of the internal combustion engine in accordance with the present invention.

A stepped piston 2 is provided in each of the cylinders 1 and has a piston rod 3. The piston rods 3 are connected with a slider 4, as shown in FIG. 1. Each cylinder 1 has injection valves 14 and transfer valves 13, as shown in FIG. 2.

Figure 3:
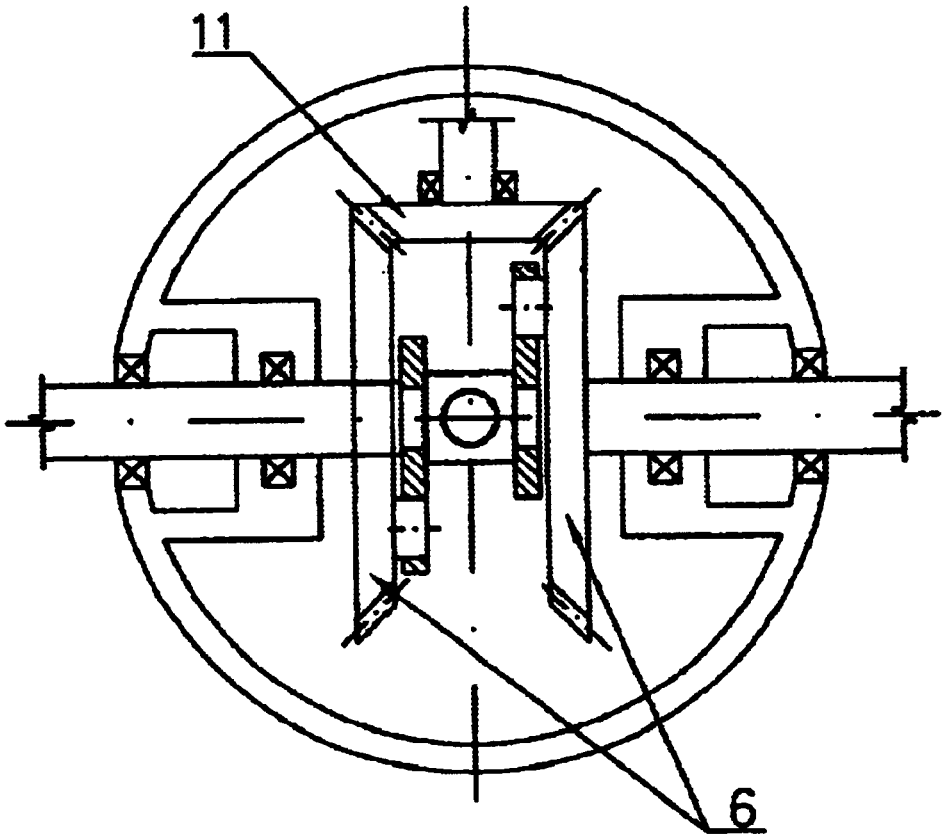
FIG. 3 is a view showing details of the transmission of the inventive internal combustion engine.

The slider 4 is connected by collar pins 8 and 15 to driving pinions 6, as shown in FIG. 1. The driving pinions 6 are rotated in opposite directions during the displacement of the slider 4. As shown in FIG. 3, the driving pinions 6 are connected with one another through a conical pinion gear 11 by interengaging teeth of the driving pinions 6 and of the gear 11. The gear 11 has an output shaft for transmitting its rotation to a transmission.

In operation when the pistons 2 are displaced in the cylinders 1, their displacing movement is transmitted to the slider 4 which in turn rotates the driving pistons 6 which correspondingly rotate the pinion gear 11.

When the engine is designed in accordance with the present invention, it has the advantage that it provides the use of a second half of the cycle, which in existing internal combustion engines produces only additional resistance. The efficiency of this design is 80+/−%.

If the length of the slider 4 exceeds the radius of rotation of the driving pinions 6, then the piston throw will be 2R or D, where R is a radius of the crank, D is a diameter of the cylinder. If the length of the slider 4 is equal to a radius of rotation of the driving pinions 6, then the piston throw is 4R or 2D—for the low speed engines.

This provides 100% compression and a high power source. Because of the high temperature working regime, the internal combustion engine is environmentally clean. The carbon monoxide is burnt up.

The internal combustion engine in accordance with the present invention is environmentally clean, it has a high efficiency, and it has a small size and weight.

What is claimed is:

1. An internal combustion engine, comprising two cylinders located opposite to one another, two pistons each movable in a respective one of said cylinders and connected with one another so as to move jointly in said cylinders in two opposite directions; and means for converting the joint movement of said pistons into a rotary movement; valve means provided in said cylinders, so that when said pistons jointly move in one direction one of said pistons performs a working stroke in one of said cylinders, while when said pistons jointly move in an opposite direction the other of said pistons perform a working stroke in the other of said cylinders; and further comprising means for connecting said pistons with one another and including two piston rods each connected to a respective one of said pistons and also connected with one another by a slider, said converting means including two driving pinions located near one another in an axial direction and both connected with said slider so as to rotate in opposite directions, and a pinion gear engaging with said driving pinions and rotatable by the latter to transmit rotation from said pinion gear to a further transmission.

2. An internal combustion engine as defined in claim 1, and further comprising a body, said driving pinions and said pinion gear being located in said body, and said pinion gear having an output shaft extending outwardly beyond said body, said cylinders being connected with said body.

* * * * *